US010569914B2

(12) United States Patent
Foy et al.

(10) Patent No.: US 10,569,914 B2
(45) Date of Patent: Feb. 25, 2020

(54) SHOCK ABSORBING FEED WHEEL ASSEMBLY

(71) Applicant: Signode Industrial Group LLC, Glenview, IL (US)

(72) Inventors: Michael Brydon Foy, Skokie, IL (US); Dustin D. Elliot, Grayslake, IL (US)

(73) Assignee: Signode Industrial Group LLC, Glenview, IL (US)

( * ) Notice: Subject to any disclaimer, the term of this patent is extended or adjusted under 35 U.S.C. 154(b) by 253 days.

(21) Appl. No.: 15/591,373

(22) Filed: May 10, 2017

(65) Prior Publication Data

US 2017/0349306 A1 Dec. 7, 2017

Related U.S. Application Data

(60) Provisional application No. 62/344,113, filed on Jun. 1, 2016.

(51) Int. Cl.
*B65B 13/18* (2006.01)
*B65B 13/02* (2006.01)
(Continued)

(52) U.S. Cl.
CPC ..... *B65B 13/187* (2013.01); *B65B 13/02* (2013.01); *B65B 13/22* (2013.01); *B65B 13/24* (2013.01)

(58) Field of Classification Search
None
See application file for complete search history.

(56) References Cited

U.S. PATENT DOCUMENTS

2007/0037644 A1* 2/2007 Mevissen ..... F16D 7/022 474/70
2013/0276415 A1 10/2013 Haberstroh et al.
2017/0015450 A1* 1/2017 Huber ..... B65B 13/06

FOREIGN PATENT DOCUMENTS

EP 0703146 A1 3/1996
EP 1151921 A2 11/2001
(Continued)

OTHER PUBLICATIONS

International Search Report issued by ISA/EPO in connection with PCT/US2017/032476 dated Aug. 10, 2017.
(Continued)

*Primary Examiner* — Hemant Desai
*Assistant Examiner* — Tanzim Imam
(74) *Attorney, Agent, or Firm* — Levenfeld Pearlstein, LLC

(57) ABSTRACT

A strapping machine of the type that feeds, retracts, tensions and seals strap to itself to form a loop of strap around a load, has a shock absorbing feed wheel assembly. The machine includes a frame, a feed head having a motor, a tension head, a sealing head and a strap chute mounted to the frame. The feed wheel assembly has a friction engaging surface and at least one pocket formed therein. A spring hub is engaged with the feed wheel and has at least one pocket formed therein corresponding to the feed wheel pocket. The spring hub is operably connected to the feed head motor. At least one spring is positioned in the feed wheel pocket and the spring hub pocket and is sandwiched between the feed wheel and the spring hub. The feed wheel is driven by rotation of the spring hub and engagement of the spring with the feed wheel pocket and spring hub pocket. The shock absorbing feed wheel assembly dampens the forces on the feed head
(Continued)

motor and drive when the feed wheel comes to an abrupt stop and prevents strap slippage.

13 Claims, 5 Drawing Sheets

(51) Int. Cl.
*B65B 13/22* (2006.01)
*B65B 13/24* (2006.01)

(56) References Cited

FOREIGN PATENT DOCUMENTS

| | | | |
|---|---|---|---|
| JP | 2010043651 | A | 2/2010 |
| WO | 9822348 | A1 | 5/1998 |
| WO | 2009055176 | A1 | 4/2009 |
| WO | 2012094225 | A1 | 7/2012 |

OTHER PUBLICATIONS

International Preliminary Report on Patentability issued by IB in connection with PCT/US2017/032476 dated Dec. 13, 2018.

* cited by examiner

SHOCK ABSORBING FEED WHEEL ASSEMBLY

CROSS-REFERENCE TO RELATED APPLICATION DATA

This application claims the benefit of and priority to Provisional U.S. Patent Application Ser. No. 62/344,113, filed Jun. 1, 2016, the disclosure of which is incorporated herein by reference.

BACKGROUND

The present disclosure pertains to shock absorbing feed wheel assemblies. Powered strapping machines use a feed wheel as part of a feed assembly or feed head to feed strap through a chute, retract the strap, and tension and seal the strap on the load. One known strapping machine that uses a modular feed head is illustrated and disclosed in Haberstroh, US Publication 2013/0276415, which publication is incorporated herein in its entirety. The feed head draws strap from a supply and feeds the strap around the strap chute until a lead end of the strap is received at a sealing head. The feed head then reverses to draw or retract the strap from the chute onto the load. The strap is then tensioned, cut from the supply and sealed to itself to strap the load.

The feed head has a feed motor and gearbox that drive a feed wheel to feed and retract the strap. The gearbox has a slotted output shaft. A shaft adapter is mounted to the output shaft by an output shaft key so that the output shaft and adapter rotate together. A pin is inserted through two opposing holes in the output shaft and adapter to retain the adapter feed wheel axially in place on the output shaft. One known feed head configuration is illustrated in FIG. 2.

The feed wheel is mounted to the adapter shaft in a keyed arrangement similar to the way in which the adapter is mounted to the output shaft. A spacer ring on an end of the adapter (beyond the feed wheel) and a shaft support plate with an opening to receive an end of the adapter secure the feed wheel in the assembly.

When the feed assembly reverses to draw the strap onto the load (or take-up the strap), the strap may come to an abrupt stop. This is particularly so when strapping hard or solid materials, such as metal coils, ingots and the like. As a result, the energy from the abruptly stopping strap can send a shock through the feed wheel, the adapter, the keys and the gearbox and output shaft. Such shocks can result in stresses on the keys and the adapter and can result in premature failure of the keys, adapter and gearbox.

Moreover, in this known arrangement there may be slippage between the strap being retracted and the friction surface of the feed wheel. This can result in premature wear of the feed wheel surface.

Accordingly, there is a need for a feed wheel assembly that absorbs the shock of abruptly stopping strap. Desirably such a feed wheel assembly permits feeding and retracting or taking up strap without impact on machine operations. More desirably still, such a feed wheel assembly absorbs the shock when the strap abruptly stops, and does so without allowing the strap to slip when retracted.

SUMMARY

Various embodiments of the present disclosure provide a shock absorbing feed wheel assembly for a strapping machine. The feed wheel assembly is used in a powered strapping machine as part of a feed head to feed strap through a chute, retract the strap from the chute onto and around the load. The shock absorbing feed wheel assembly absorbs the force of abruptly stopping strap S in the strapping machine feed head and reduces the stresses that would otherwise be induced in feed head motor and drive. In addition, the feed wheel assembly prevents strap slippage and premature wear of the feed wheel frictional surface.

In an embodiment the feed wheel assembly includes a feed wheel having a friction engaging surface and at least one pocket formed therein. In some embodiments, the friction engaging surface includes a toothed or serrated formation therein.

A spring hub is engaged with the feed wheel. The spring hub has at least one pocket formed therein corresponding to and aligned with the feed wheel pocket. The spring hub is operably connected to and driven by the motor.

At least one biasing element is positioned in the at least one feed wheel pocket and the at least one spring hub pocket, such that the biasing element is sandwiched between, and operably, rotationally connects the feed wheel and the spring hub. The feed wheel is driven by rotation of the spring hub and engagement of the biasing element with the feed wheel pocket and the spring hub pocket. In some embodiments the biasing element is a spring. The spring can be a coil spring.

In an embodiment, the feed wheel and the spring hub each have four pockets, each of the respective feed wheel pockets aligned with a respective one of the spring hub pockets to form a pocket pair. The assembly includes four biasing elements, one biasing element positioned in each of the pocket pairs. In an embodiment, the respective pockets pairs in the spring hub and feed wheel are equally circumferentially spaced from one another. An embodiment of the feed wheel assembly includes a radially extending inwardly oriented flange in the feed wheel in which the pockets are formed.

In some embodiments, the feed wheel assembly includes a shaft adapter that operably connects the feed head motor output shaft and the spring hub. The shaft adapter can include a sleeve and a back plate. The shaft adapter sleeve fits over the motor output shaft. Slots formed in the adapter sleeve and the motor output shaft are configured to receive a key to operably connect the output shaft and the shaft adapter. The spring hub and shaft adapter can be mounted to one another in a similar manner. Slots formed in the adapter sleeve and the spring hub are configured to receive a key to operably connect the shaft adapter and the spring hub.

In an embodiment a disk spring is positioned outboard of the spring hub and is configured to maintain the shaft adapter, feed wheel and the biasing element in a sandwiched state. A bearing can be positioned outboard of the spring hub. The bearing can fit into a recess in a shaft support plate.

An embodiment of a strapping machine of the type that feeds, retracts, tensions and seals strap to itself to form a loop of strap around a load, includes a frame, a feed head having a motor with an output shaft mounted to the frame, and a tension head, a sealing head and a strap chute mounted to the frame.

The feed head includes a feed wheel assembly having a feed wheel having a friction engaging surface. In some embodiments, the friction engaging surface is a toothed or serrated formation. The feed wheel has at least one pocket formed therein. A spring hub is engaged with the feed wheel and has at least one pocket formed therein corresponding to the feed wheel pocket. The spring hub is operably connected to, and driven by, the feed head motor output shaft.

At least one biasing element is positioned in the at least one feed wheel pocket and the at least one spring hub pocket, such that the biasing element is sandwiched between, and operably, rotationally connects the feed wheel and the spring hub. The feed wheel is driven by rotation of the spring hub by the feed head motor output shaft, and engagement of the biasing element with the feed wheel pocket and the spring hub pocket. The feed head assembly dampens the forces on the feed head motor output shaft when the feed wheel comes to an abrupt stop.

In an embodiment, the biasing element is a coil spring. In some embodiments the feed wheel and the spring hub each have four pockets formed therein, each of the respective feed wheel pockets aligned with a respective one of the spring hub pockets to form a pocket pair. The biasing elements, such as coil springs can be positioned in each of the pocket pairs. In some embodiments that include multiple pockets and springs, the pockets in the spring hub and the pockets in the feed wheel (e.g., the pocket pairs) are equally circumferentially spaced from one another.

In an embodiment, the feed wheel assembly includes a shaft adapter that operably connects the feed head motor output shaft and the spring hub. The feed head motor output shaft and the shaft adapter are fixedly mounted to one another, and the shaft adapter and the spring hub are fixedly mounted to one another, such that the feed head motor drives the spring hub. The feed head motor output shaft and the shaft adapter, and the shaft adapter and the spring hub, can be fixedly mounted to one another by corresponding slots formed in the adapter sleeve and the motor output shaft, and in the adapter sleeve and spring hub, each set of slots configured to respectively receive a key to operably connect the output shaft and the shaft adapter, and to operably connect the shaft adapter and the spring hub.

A disk spring can be positioned outboard of the spring hub. The disk spring is configured to maintain the shaft adapter, feed wheel and biasing elements in a sandwiched state.

Other objects, features, and advantages of the disclosure will be apparent from the following description, taken in conjunction with the accompanying sheets of drawings, wherein like numerals refer to like parts, elements, components, steps, and processes.

DETAILED DESCRIPTION

Figure 1:
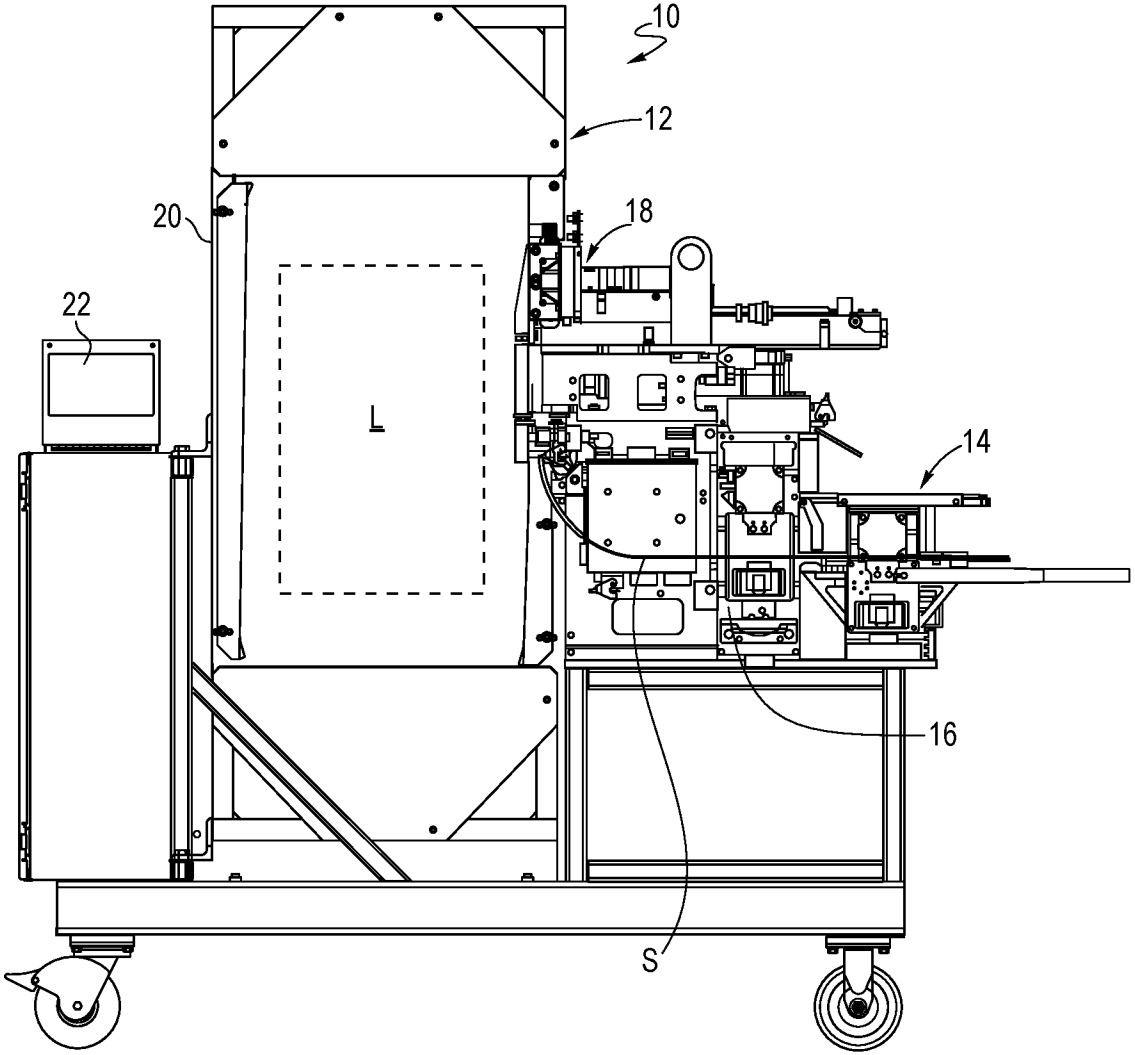
FIG. 1 is an illustration of a strapping machine having a feed head with an embodiment of a shock absorbing feed wheel assembly.
Figure 2:
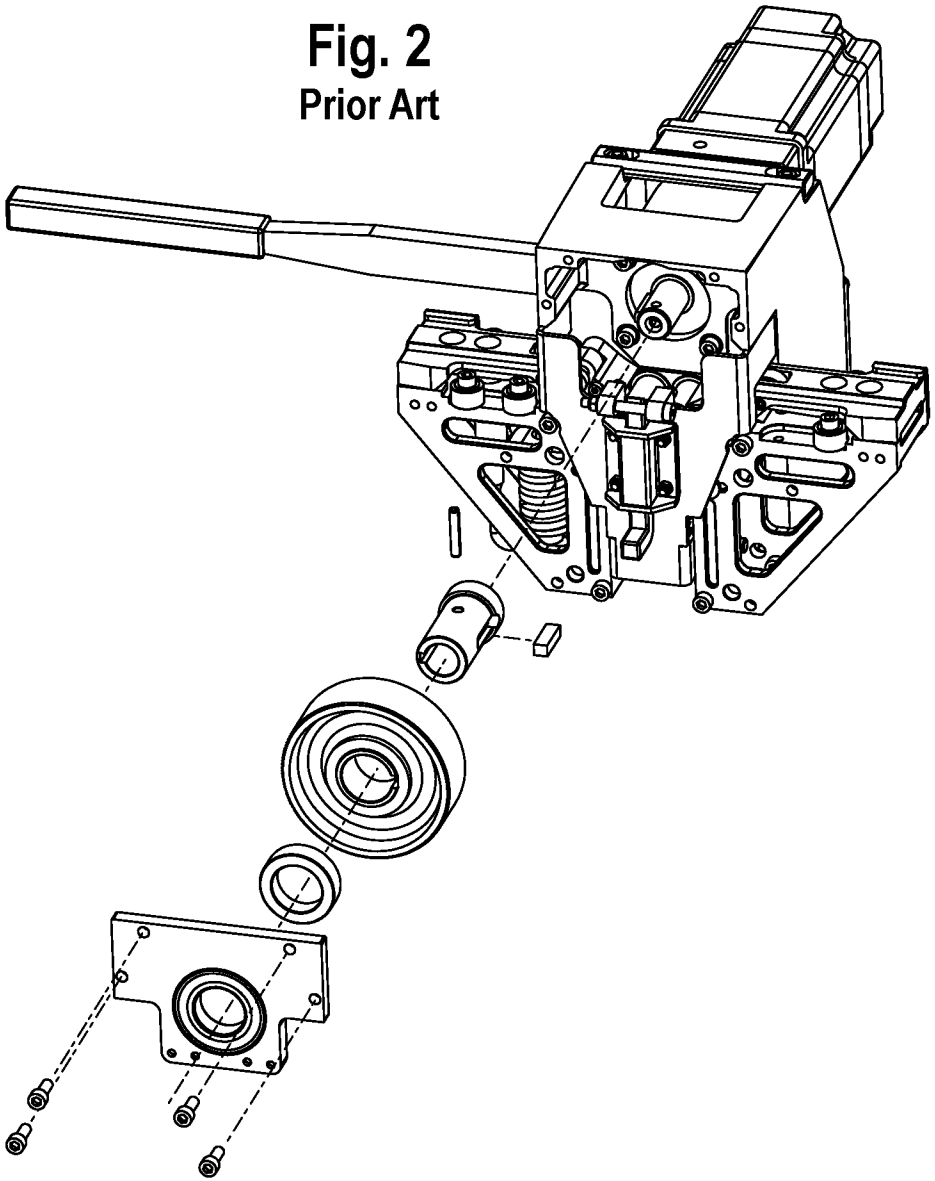
Fig. 2 Prior Art
FIG. 2 is a partially exploded view of a prior art feed head.

While the present disclosure is susceptible of embodiment in various forms, there is shown in the drawings and will hereinafter be described one or more embodiments with the understanding that the present disclosure is to be considered illustrative only and is not intended to limit the disclosure to any specific embodiment described or illustrated.

Referring now to the FIG. 1, an example of a strapping machine 10 is shown. The strapping machine 10 is configured for use with steel strap S that can be tensioned and sealed to itself to form a loop of strap around a load L. The strapping machine 10 includes, generally, a frame 12, a feed head 14, a tension head 16, a sealing head 18 and a strap chute 20 through which the strap S is conveyed around the load L. Strap S is fed from a strap supply such as a strap dispenser (not shown). In an embodiment, the strapping machine 10 is controlled by a controller 22.

Briefly, in a typical operation, strap S is pulled from the dispenser and fed into the machine 10 by the feed head 14. The feed head 14 conveys the strap S through the tension head 16, through the sealing head 18, into and around the strap chute 20 and back to the sealing head 18 in a forward direction. Once the lead end of the strap S is secured in the sealing head 18, the feed head 14 operates in reverse to withdraw or retract the strap S from the strap chute 20 onto the load L. The tension head 16 then draws tension in the strap S as it is positioned around the load L and holds tension in the strap S at the commencement of the sealing cycle.

The timing of the strap feed and retraction portions of the cycle can be quite quick and are carried out automatically and sequentially. As such, when the strap S is retracted it can come to an abrupt stop once it is drawn tightly around the load L. This is especially so when the load L is hard or solid materials, such as metal coils, ingots and the like, because these materials have no resilience. That is, there is no "give" in these materials. In addition, the retracted strap can slip along the feed wheel surface resulting in premature wear of the feed wheel surface.

Figure 3:
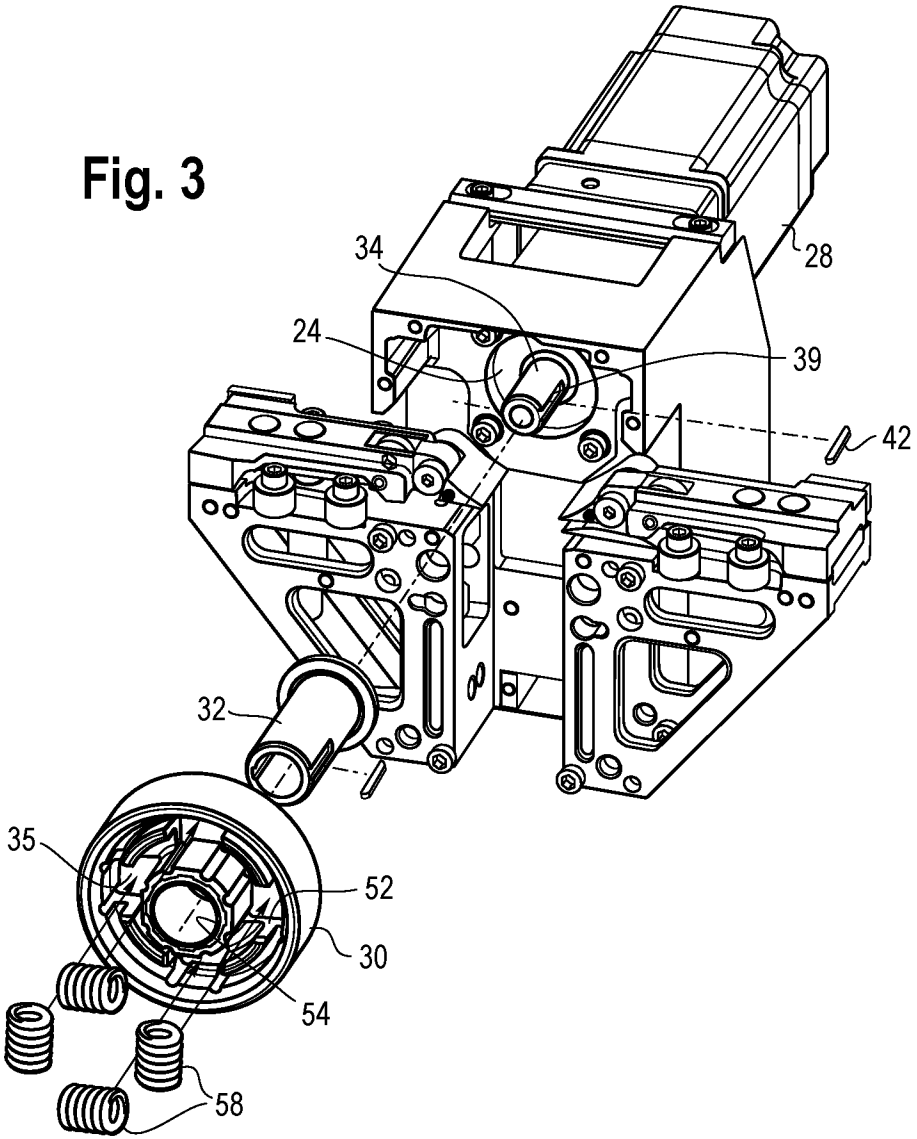
FIG. 3 is a partially exploded view of an embodiment of a feed head with a shock absorbing feed wheel assembly, illustrating one example of the feed wheel, shaft adapter and springs.
Figure 4:
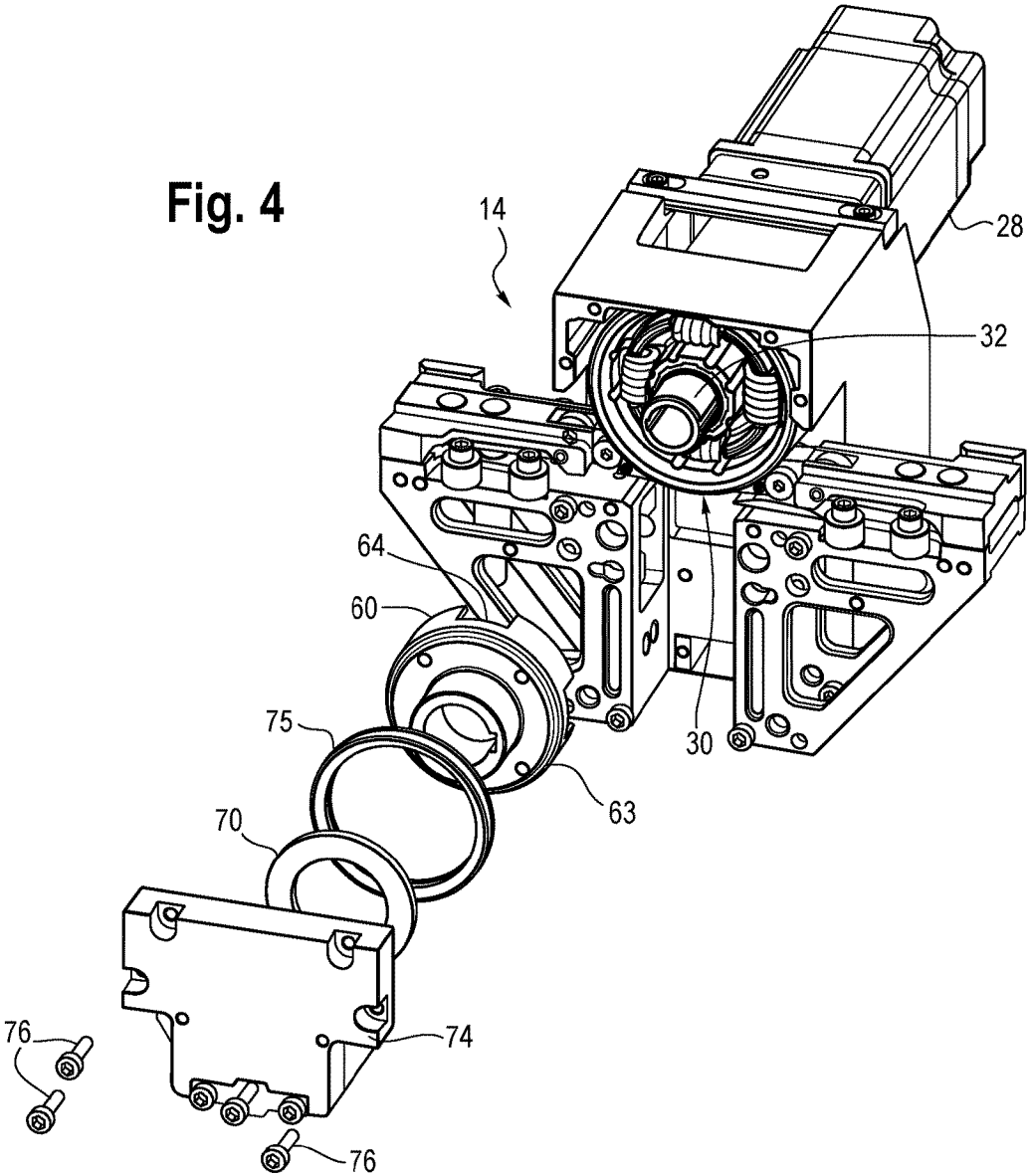
FIG. 4 is a partially exploded view of an embodiment of the feed wheel assembly illustrating one example of the spring hub, seal, disk spring and support plate.
Figure 5:
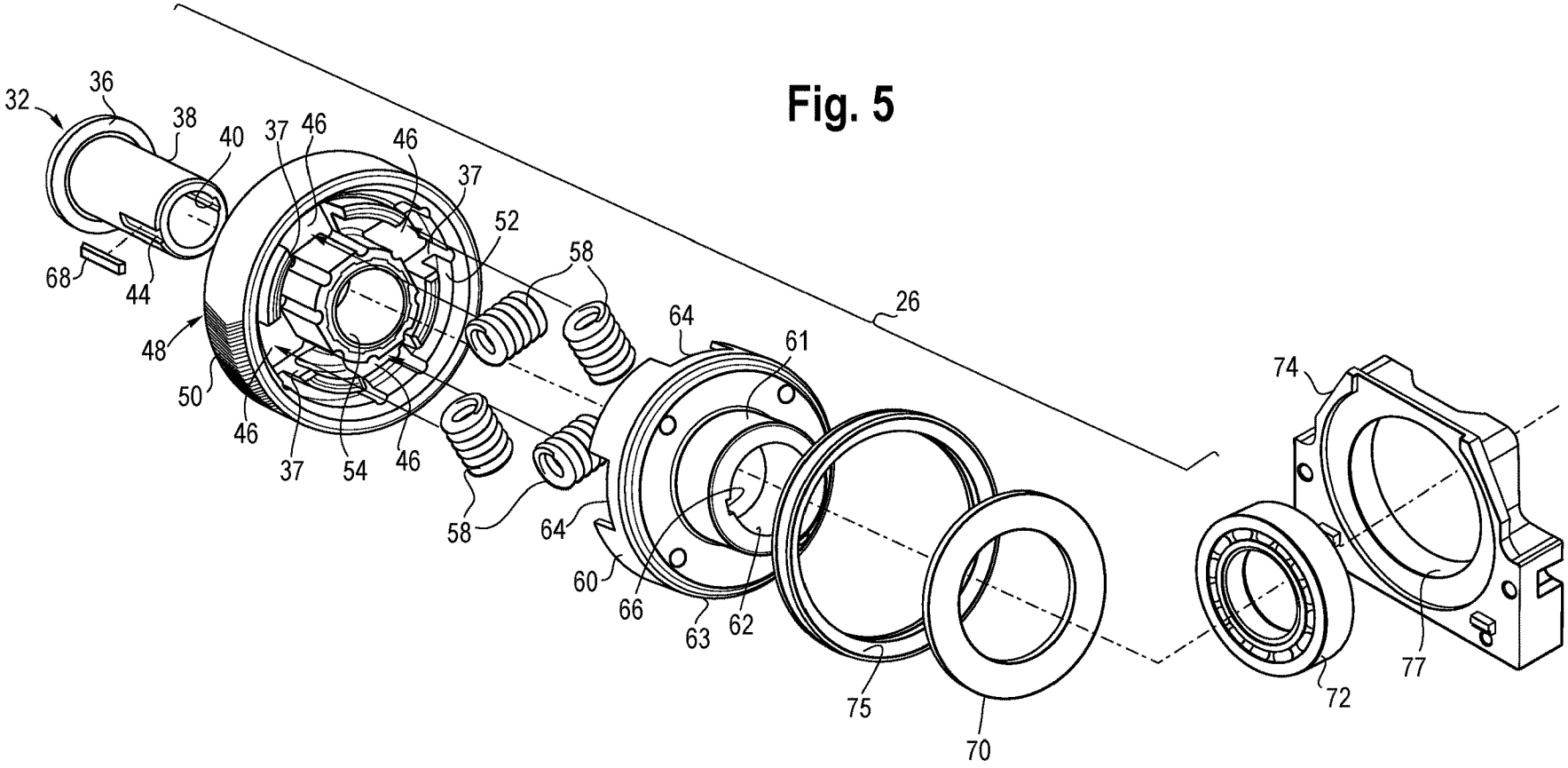
FIG. 5 is a an exploded view of the feed wheel assembly.

In order to lessen the stresses or dampen the forces on the feed head 14, and to prevent strap slippage, an embodiment of the shock absorbing feed wheel assembly 26 includes a biased connection between the drive elements of the feed head 14, e.g., a feed motor 28 and a feed wheel 30. Referring to FIGS. 3-5, an embodiment of the shock absorbing feed wheel assembly 26 includes a shaft adapter 32 that is mounted to a gearbox 24 at the gearbox output shaft 34 using a keyed configuration. The shaft adapter 32 has a back plate 36 and a sleeve 38 extending from the back plate 36. The sleeve 38 fits over the gearbox output shaft 34. In an embodiment, a slot 40 in the interior of the sleeve 38 and a slot in 39 on the exterior of the output shaft 34 cooperate to receive a key 42 to secure the output shaft 34 and the sleeve 38. In this manner, the gearbox output shaft 34 rotationally drives the shaft adapter 32. The sleeve 38 also includes a slot 44 in an outer surface as discussed in more detail below.

In an embodiment, the feed wheel 30 has an outer rim 48 with a frictional gripping surface 50 and a radially extending, inwardly oriented, circumferential flange 52. The flange 52 has a central opening 54 to fit over the shaft adapter sleeve 38. The feed wheel 30 includes at least one pocket or recess 46 formed in the flange 52. In an embodiment, the feed wheel flange 52 includes four pockets 46 that extend circumferentially around the flange 52 in an interior 35 of the feed wheel 30. The pockets 46 can be formed equally circumferentially spaced from one another which, as shown, when the feed wheel 30 includes four pockets 46, are at 90 degrees from one another.

Biasing elements 58 are positioned and seated in the feed wheel pockets 46. In an embodiment the biasing elements 58 are coil springs, such as die springs that fit into the pockets 46. Projections or walls 37 on the sides of the pockets 46 maintain the springs 58 in place in the pockets 46.

A spring hub 60 has a stub 61 having a central opening 62 and is positioned on the adapter sleeve 38 outboard of the feed wheel 30. In an embodiment the spring hub 60 includes one or more pockets 64 that correspond to or align with the feed wheel flange pockets 46. The illustrated embodiment of the assembly 26 includes four such pocket pairs, each pocket pair being a feed wheel pocket 46 and its corresponding spring hub pocket 64. Although four feed wheel pockets 46, biasing elements 58 and spring hub pockets 64 are shown, the shock absorbing feed wheel assembly 26 can include any number, for example, between one and five or six pockets 46, 64 (e.g., pocket pairs) and biasing elements 58. Those skilled in the art will appreciate that more or less of these can be used as desired. In an embodiment, the spring hub has an peripheral channel or recess 63 formed therein, discussed in more detail below.

When assembled, the feed wheel 30 abuts the back plate 36 and the spring hub 60 engages and abuts the feed wheel 30 to sandwich the springs 58 between the feed wheel 30 and the spring hub 60. The spring hub 60 has a slot 66 in the central opening 62. A key 68 is positioned in the spring hub slot 66 and the adapter sleeve outer slot 44. The key 68 affixes and locks rotation of the shaft adapter 32 and the spring hub 60, again, with the feed wheel 30 and springs 58 sandwiched between the adapter 32 and hub 60.

In an embodiment, one or more springs, such as the illustrated disk spring 70 and a taper bearing 72 are positioned over the end of the shaft adapter sleeve 38. The spring 70 and taper bearing 72 are positioned at the spring hub stub 61, so as to minimize exposure of the bearing to debris. In an embodiment, a seal 75 is positioned in spring hub channel 63 to prevent debris (for example, debris generated by the feed wheel 30 engaging the strap S) from entering the bearing 72.

A shaft support plate 74 is positioned outboard of the taper bearing 72, shaft adapter sleeve 38 and spring hub stub 61 to retain the shock absorbing feed wheel assembly 26 as assembled and in place in the feed head 14, and in engagement with the gearbox output shaft 34. In an embodiment the shaft support plate 74 includes a recess 77 in which the bearing 72 is seated. The shaft support plate 74 is secured to the feed head 14 by fasteners 76. The force of the disk spring 70 against the taper bearing 72 (which bears against the shaft support plate 74) and against the spring hub 60 ensures that the components of the feed wheel assembly 26 all fully engage one another and that the assembly 26 remains in place (longitudinally relative to the gearbox 24) with the die springs 58 in place in the feed wheel pockets 46 and spring hub pockets 64. That is, the disk spring 70 being positioned outboard of the spring hub 60 maintains the hub 60, feed wheel 30 and springs 58 in a sandwiched state.

In an embodiment, the die springs 58 are configured with a sufficiently high spring rate (stiffness) so that the springs 58 do not compress during normal feed and take-up (retraction) portions of the cycle. Rather, the springs 58 are configured so that they compress between the hub pocket 64 walls and the feed wheel walls or projections 37 when the wheel 30 abruptly stops, or when there is significant tension in the strap S to prevent the strap S from slipping along the feed wheel surface 50. Once the forces due to the abruptly stopping strap S cease or once the tension in the strap is relieved, the springs 58 return the feed wheel 30 to an original position (non-compressed spring 58 condition) relative to the gearbox 24 and output shaft 34, ready for the next strapping cycle.

The shock absorbing feed wheel assembly 26 in accordance with the examples of the present disclosure provides a number of advantages over fixed feed wheel assemblies. For example, when the feed head 14 reverses to draw the strap S onto hard or solid loads L, such as metal coils and the like, and the strap S comes to an abrupt stop, the springs 58 in the feed wheel assembly 26 absorb the force of the abruptly stopping strap S, and the stresses that would otherwise be induced in the adapter, keys, gearbox and output shaft of a fixed system, thus potentially preventing premature failure of these components.

Moreover, because feed wheels 30 typically have a serrated or toothed friction surface 50, high frictional forces are created between the wheel surface 50 and the strap S. Thus, when there is a fixed connection between the wheel and the strap, as the strap comes to a stop, the strap may pull or slip between the wheel surface and an anvil against which the strap is held, or if the friction is sufficiently high, the forces can be induced back into the gearbox. Again, the present shock absorbing feed wheel assembly 26 has a biased or floating connection between the feed wheel 30 and the gearbox 24 which prevents such strap S slippage, and prevents premature wear or failure of the feed wheel frictional surface 50, thus prolonging the life of the feed wheel frictional surface 50.

In addition, the use of one or more outboard springs 70, such as the disk spring in the illustrated embodiment, provides positive engagement of the feed wheel assembly 26 with the gear box 24 and output shaft 34 in the axial direction, thus eliminating the need for pins or other securing elements to maintain the feed wheel assembly engaged with the gear box output shaft.

It will be appreciated by those skilled in the art that the relative directional terms such as sides, upper, lower, rearward, forward and the like are for explanatory purposes only and are not intended to limit the scope of the disclosure.

All patents or patent applications referred to herein, are hereby incorporated herein by reference, whether or not specifically done so within the text of this disclosure.

In the present disclosure, the words "a" or "an" are to be taken to include both the singular and the plural. Conversely, any reference to plural items shall, where appropriate, include the singular.

It should be understood that various changes and modifications to the presently preferred embodiments disclosed herein will be apparent to those skilled in the art. Such changes and modifications can be made without departing from the spirit and scope of the present disclosure and without diminishing its intended advantages. It is therefore intended that such changes and modifications be covered by the appended claims.

The invention claimed is:

1. A feed wheel assembly for a strapping machine, the strapping machine having a feed head having a motor, the feed wheel assembly comprising:

a feed wheel having a friction engaging surface and defining a feed wheel pocket;

a spring hub defining a spring hub pocket and engaged with the feed wheel such that the spring hub pocket is aligned with the feed wheel pocket, the spring hub being operably connectable to the motor; and a biasing element positioned in the feed wheel pocket and the spring hub pocket such that the biasing element is sandwiched between and operably connects the feed wheel and the spring hub such that rotation of the spring hub drives the feed wheel by engagement of the biasing element with the feed wheel and the spring hub.

2. The feed wheel assembly of claim 1 wherein the biasing element is a spring.

3. The feed wheel assembly of claim 2 wherein the spring is a coil spring.

4. The feed wheel assembly of claim 1, wherein the feed wheel defines four feed wheel pockets and the spring hub defines four spring hub pockets, wherein the spring hub is engaged with the feed wheel such that each of the feed wheel pockets is aligned with a different one of the spring hub pockets to form a pocket pair, the feed wheel assembly further including four biasing elements, each biasing element positioned in a different one of the pocket pairs.

5. The feed wheel assembly of claim 4, wherein the pocket pairs are equally circumferentially spaced from one another.

6. The feed wheel assembly of claim 1, wherein the feed wheel includes a radially inwardly extending flange, and wherein the feed wheel pocket is defined in the flange.

7. The feed wheel assembly of claim 1, further including a shaft adapter configured to operably connect the motor and the spring hub.

8. The feed wheel assembly of claim 7, wherein the spring hub and the shaft adapter are mountable to one another by a key in slot configuration such that the shaft adapter and the spring hub rotate together.

9. The feed wheel assembly of claim 8, wherein the shaft adapter includes a sleeve and wherein the sleeve and the spring hub each have a slot formed therein, the feed wheel assembly further including a key sized to be received in the slot of the sleeve and the slot of the spring hub.

10. The feed wheel assembly of claim 1 wherein the friction engaging surface of the feed wheel includes a toothed or serrated formation therein.

11. The feed wheel assembly of claim 1, wherein the feed wheel pocket and the spring hub pocket form a pocket pair in which the biasing element is positioned.

12. The feed wheel assembly of claim 1, wherein the feed wheel includes a projection that at least in part defines the feed wheel pocket.

13. The feed wheel assembly of claim 12, wherein the biasing element engages the projection.

* * * * *